US007648140B2

(12) United States Patent
Silverman

(10) Patent No.: US 7,648,140 B2
(45) Date of Patent: Jan. 19, 2010

(54) METHOD AND APPARATUS FOR PLAYING A BLACKJACK GAME WITH SIDE WAGERS

(75) Inventor: Bruce David Silverman, Minneapolis, MN (US)

(73) Assignee: Applied Gaming Dynamics, LLC, Edina, MN (US)

( * ) Notice: Subject to any disclaimer, the term of this patent is extended or adjusted under 35 U.S.C. 154(b) by 533 days.

(21) Appl. No.: 11/540,399

(22) Filed: Sep. 28, 2006

(65) Prior Publication Data

US 2007/0069469 A1 Mar. 29, 2007

Related U.S. Application Data

(60) Provisional application No. 60/735,537, filed on Nov. 10, 2005, provisional application No. 60/728,499, filed on Oct. 20, 2005, provisional application No. 60/721,755, filed on Sep. 29, 2005.

(51) Int. Cl.
*A63F 1/00* (2006.01)
*A63F 9/24* (2006.01)

(52) U.S. Cl. ..... 273/292; 463/12; 463/14; 273/303

(58) Field of Classification Search ..... 273/292
See application file for complete search history.

(56) References Cited

U.S. PATENT DOCUMENTS

| | | | | |
|---|---|---|---|---|
| 5,673,917 | A * | 10/1997 | Vancura | 273/292 |
| 5,836,586 | A | 11/1998 | Marks et al. | |
| 6,113,102 | A | 9/2000 | Marks et al. | |
| 6,227,969 | B1 * | 5/2001 | Yoseloff | 463/13 |
| 6,637,746 | B1 * | 10/2003 | Baranauskas | 273/292 |
| 6,679,497 | B2 | 1/2004 | Walker et al. | |
| 6,969,316 | B2 | 11/2005 | Jarvis et al. | |
| 7,144,011 | B2 * | 12/2006 | Asher et al. | 273/292 |

* cited by examiner

*Primary Examiner*—Gene Kim
*Assistant Examiner*—Michael D Dennis
(74) *Attorney, Agent, or Firm*—Merchant & Gould P.C.

(57) ABSTRACT

A casino-style blackjack card game that offers players the option of placing wagers against the occurrence of their hand value exceeding 21 (commonly known as busting) on the next card drawn when they have a hard card count of 12, 13, 14, 15, 16, 17, 18, 19 or 20.

9 Claims, 13 Drawing Sheets

METHOD AND APPARATUS FOR PLAYING A BLACKJACK GAME WITH SIDE WAGERS

RELATED APPLICATIONS

This application claims priority to the following U.S. Provisional patent applications: Application No. 60/735,537, filed Nov. 10, 2005; Application No. 60/728,499, filed Oct. 20, 2005; and Application No. 60/721,755, filed Sep. 29, 2005. Such applications are hereby incorporated by reference and made a part hereof.

FIELD OF THE INVENTION

This application relates generally to a method and apparatus for playing a card game; more particularly to a method and apparatus for playing a modified version of the card game Twenty-one (also known as "21" or "Blackjack") in which a player is able to place a side wager that a card count of 21 will not be exceeded on the next card drawn when the existing card count is a hard card count equaling 12, 13, 14, 15, 16, 17, 18, 19 or 20.

BACKGROUND OF THE INVENTION

The game "Blackjack" or "21" is one of the most popular casino table games. Players enjoy the game since it offers fast action and a relatively low house advantage. Casinos offer the game due to its popularity and its dependable income. However, the proliferation of jurisdictions which allow gambling (and in particular card games), and the resulting number of casinos has created increased competition and a need for new games that generate interest and participation among casino patrons. As a result, casinos are constantly exploring new variations of blackjack with various side bets that increase player "action" while retaining or increasing the casino's overall advantage in order to generate incremental income. Many of these blackjack games involve side bets based on the total or partial hand values of the dealer or player, including game variations that include some sort of bust insurance option for the player such as that disclosed in U.S. Pat. No. 6,679,497 to Walker, et al. However, many proposed blackjack side bets only offer the player the prospect of long odds and limited options, making them unattractive bets and/or impractical for an average player's bankroll.

These drawbacks in previous blackjack side bets generally result in limited interest from casino operators, as either the odds of winning these side bets are too long for the player to play on a routine or on-going basis, or there is simply a lack of interest generated by the underlying concept behind the side bet. Therefore, there is a need for a blackjack game variation that offers side bets that are attractive to players and are within an average player's bankroll. Such side bets must also not impact the underlying structure of the game in manner which lessens the appeal of blackjack and must provide enough of a house advantage that it is economically accepted by the casinos. The present invention addresses these needs.

BRIEF SUMMARY OF THE INVENTION

The present invention introduces an enhanced version of the game of blackjack by providing players with unique ways of betting on the confidence they have in their hand based on the set probabilities of a player not busting with each additional card drawn once a hard card count of at least twelve is reached. As used herein, the term "hard card count" is defined as the total of any hand not containing Aces or the total of a hand where Aces are counted as a value of one so that there can only be one count for the hand. This definition is consistent with use of the terms hard count and hard card count in the gaming industry.

One feature of the invention relates to the new betting strategies provided by games in accordance with the invention. For example, the invention provides the player with the opportunity to create hedging strategies that can influence his decision making for the underlying blackjack game. The invention also provides the player with opportunities to make side wagers during any given hand of play independent of his underlying blackjack bet against the dealer's hand.

Embodiments constructed in accordance with the principles of the present invention can be offered such that the player may switch his underlying bet against the dealer's hand to a bet specific to the invention once the qualifying conditions of his hand are met. Such embodiments can also provide the casino with an opportunity for incremental income without requiring additional space, tables or game surveillance. Still further, such embodiments can be offered by casinos as a game in and of itself (e.g., that does not involve a traditional underlying game of 21, but rather involves only the aspects of the game specific to the invention).

Another feature of the invention is that it can easily be applied to various gaming formats and media platforms, including a traditional casino-style table game, single-player and multi-player video slot machines, electronic games and devices, lottery terminals, lottery scratch-off cards, home-entertainment software, online gaming applications and online non-gaming applications.

Therefore, according to one aspect of the invention, there is provided a method of playing the card game Blackjack, the Blackjack game including a dealer and at least one player, wherein the player is dealt a hand and the cards in the dealt hand equal a hand count, comprising: placing a side wager against the occurrence of the hand count exceeding a total of twenty-one after addition of another dealt card; dealing another card to the player; and determining if the side wager is satisfied, wherein: the placed side wager is won if the additional card does not cause the hand count to exceed twenty-one; and the placed side wager is lost if the additional card causes the hand count to exceed twenty-one.

According to another aspect of the invention, there is provided an apparatus for playing the card game Blackjack, the Blackjack game including a dealer and at least one player, wherein the player is dealt a hand and the cards in the dealt hand equal a hand count, comprising: means for placing a side wager against the occurrence of the hand count exceeding a total of twenty-one after addition of another dealt card; means for dealing another card to the player; and means for determining if the side wager is satisfied, wherein: the placed side wager is won if the additional card does not cause the hand count to exceed twenty-one; and the placed side wager is lost if the additional card causes the hand count to exceed twenty-one.

While the invention will be described with respect to preferred embodiment configurations and with respect to particular table formats described therewith, it will be understood that the invention is not to be construed as limited in any manner by either such configuration or formats described herein. Instead, the principles of this invention extend to any blackjack game environment in which offering a side wager(s) on the next card not causing the player's hand to exceed a count of 21 is provided. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

The present invention will be described in detail with reference to the following drawings.

DETAILED DESCRIPTION OF THE INVENTION

Figure 1:
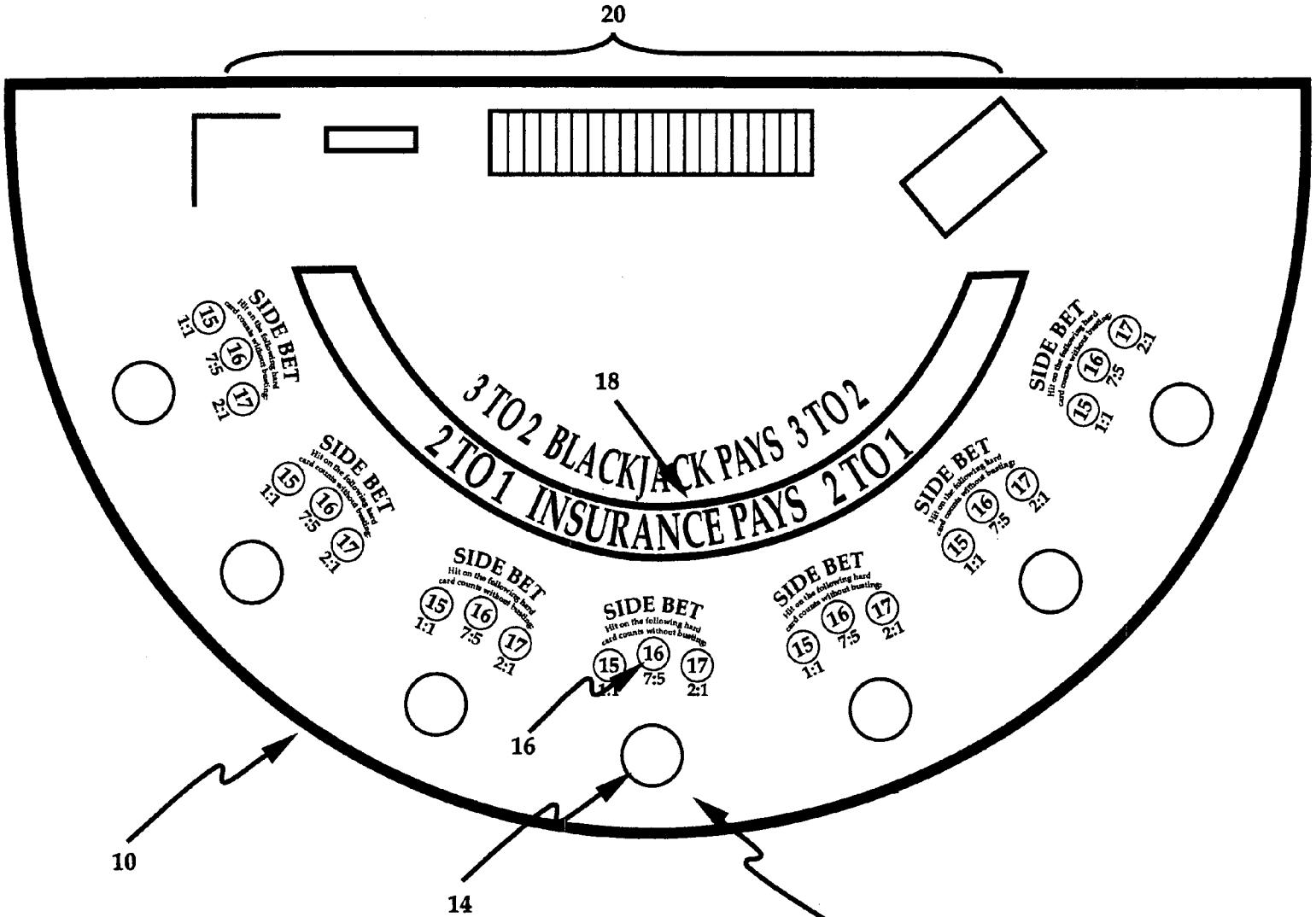
FIG. 1 is an illustration of a playing surface for a casino-style gaming table that can be utilized for the various embodiments of the invention.

Reference will now be made in detail to exemplary aspects of the present invention which are illustrated in the accompanying drawings. Wherever possible, the same reference numbers are used throughout the drawings to refer to the same or like parts.

The invention is based on a traditional game of blackjack using one or more standard 52-card decks. Given that for any of the hard card counts of 12, 13, 14, 15, 16, 17, 18, 19 or 20, there are set probabilities of the next card causing or not causing the hand value to exceed 21 (commonly known as a "bust"), unique side bets can be constructed that allow the player to bet against the likelihood of his hand value exceeding 21 on the next card drawn whenever any of those hard card counts are realized.

In reference to FIGS. 1-6, the various embodiments of the invention can be played on a casino-style blackjack table with a playing surface 10 that accommodates one or more player positions 12, a primary betting area 14 for each player to bet on the underlying blackjack game, an additional betting area 16 for each player to place side bets as they apply to the specific embodiments of the invention, inscribed guidelines of play as they relate to the underlying blackjack game 18, and a traditional blackjack dealer station 20. The dealer station 20 conforms to the needs of a blackjack dealer to conduct a traditional game of blackjack and typically includes a card dispensing device typically referred to as a shoe, a rack for holding chips, a drop slot for depositing player money and a device (or area) for collecting cards after each hand is played. The additional player betting area 16 consists of one or more spaces with inscriptions to indicate the various wagers and corresponding payouts as they pertain to the specific embodiments of the invention.

It is to be understood that the embodiments shown in FIGS. 1-6 are presented as examples of ways in which the table surface may be laid out. The table surface can be constructed in many other manners to convey the side bets specific to the invention, and so should not be construed as limiting herein.

Figure 2:
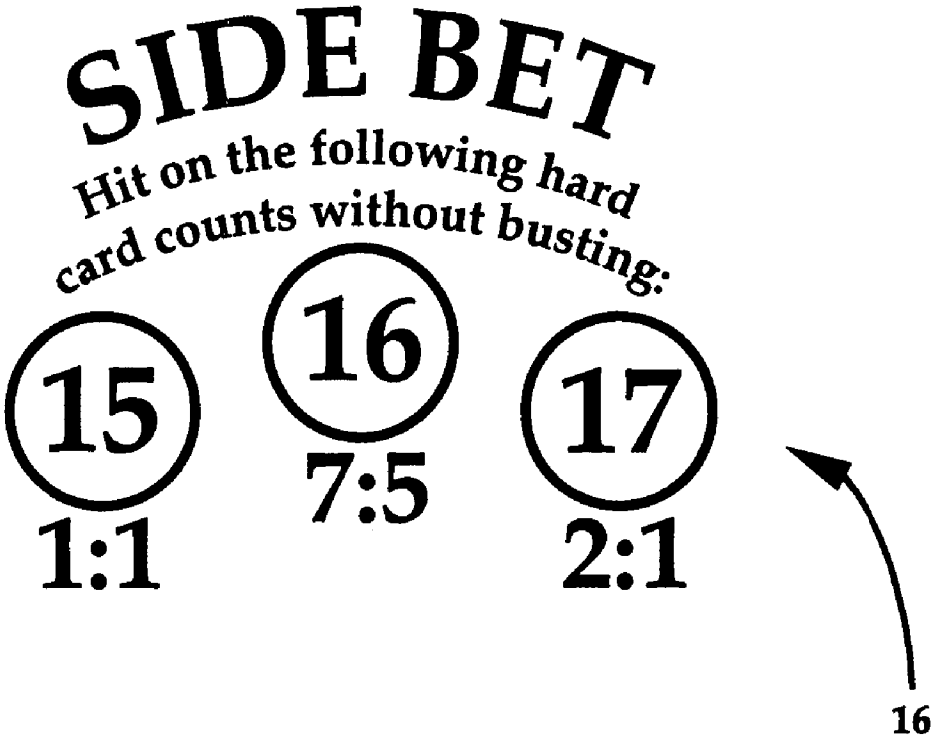
FIG. 2 is an enlarged illustration of the player betting area specific to the invention as represented in FIG. 1.

FIG. 1 represents a first embodiment of the invention where the additional player betting area 16 provides individual betting spaces for the hard card counts for which the player is allowed to place a side bet specific to the invention, and each betting space specific to the invention has indicia that indicates the payout on a successful side bet specific to the invention. FIG. 2 is an enlarged illustration of the additional player betting area 16 for the embodiments of the invention represented by FIG. 1. In this particular embodiment, the player is allowed to place a side bet that he will not bust on the next card drawn when he has a hard card count of 15, 16 or 17. However, it is to be understood that the invention allows for any combination of one or more of the nine hard card counts 12, 13, 14, 15, 16, 17, 18, 19 or 20 to be offered as side bet opportunities.

Figure 3:
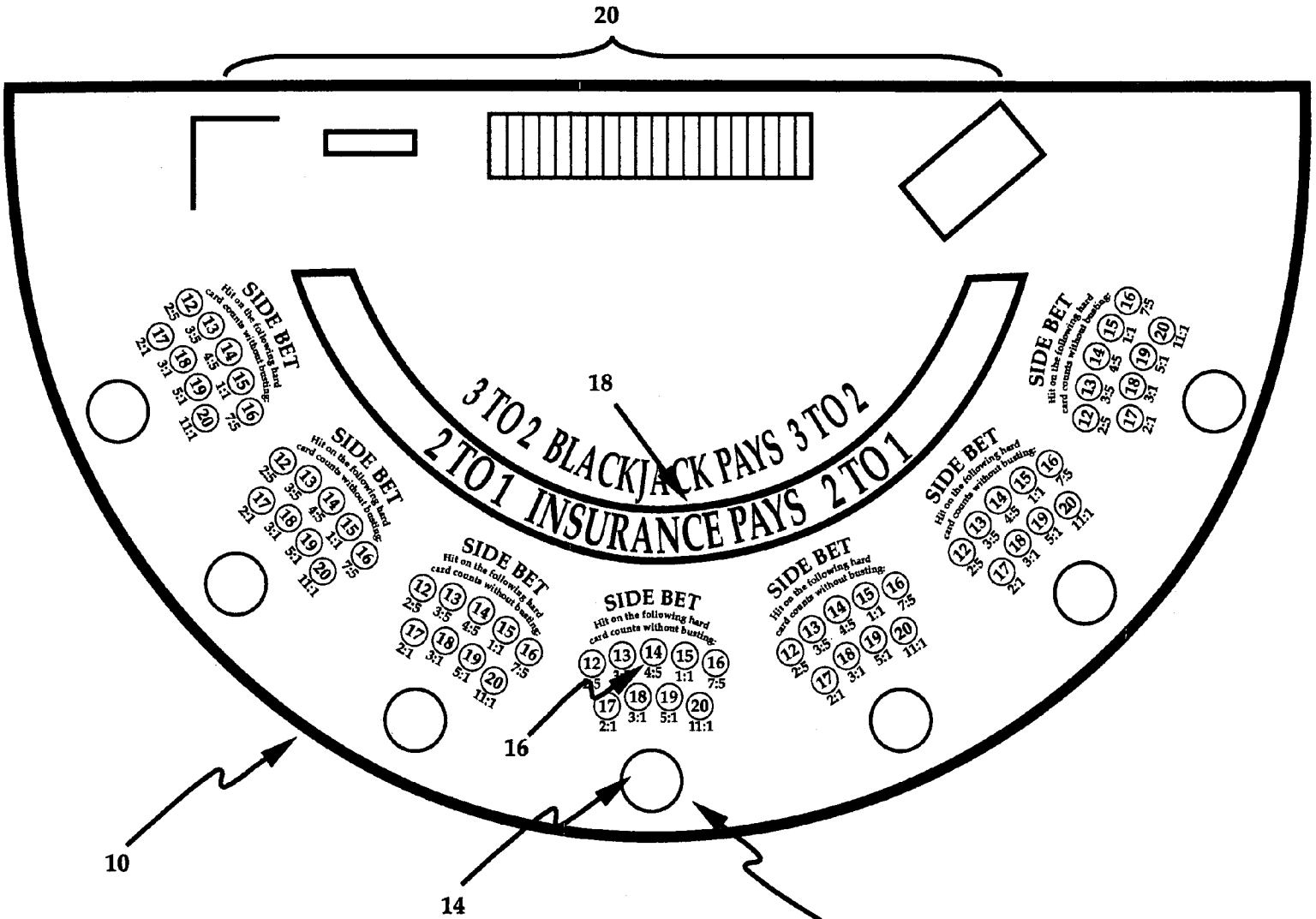
FIG. 3 is an illustration of a playing surface for a casino-style gaming table that can be utilized for the various embodiments of the invention.
Figure 4:
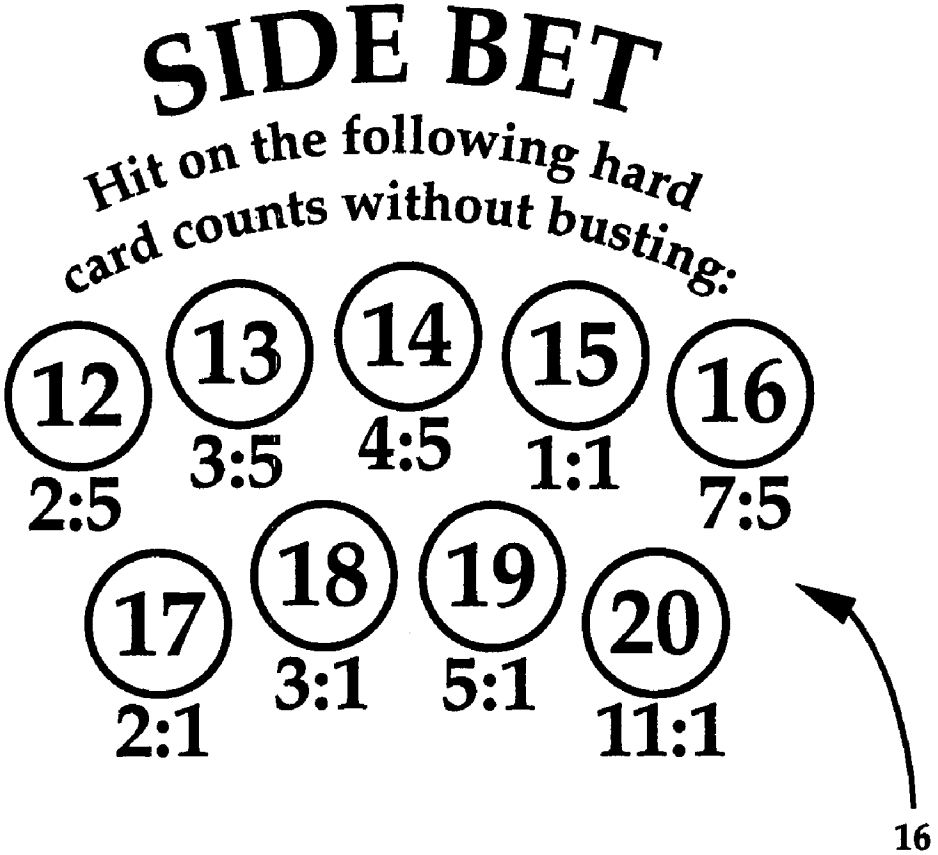
FIG. 4 is an enlarged illustration of the player betting area specific to the invention as represented in FIG. 3.

FIG. 3 represents a second embodiment of the invention where the additional player betting area 16 provides individual betting spaces for the hard card counts for which the player is allowed to place a side bet specific to the invention, and each betting space specific to the invention has indicia that indicates the payout on a successful side bet specific to the invention. FIG. 4 is an enlarged illustration of the additional player betting area 16 for the embodiments of the invention represented by FIG. 3. This embodiment allows for a side bet that the player will not bust on the next card drawn when the player has any of the nine hard card counts 12, 13, 14, 15, 16, 17, 18, 19 or 20.

Figure 5:
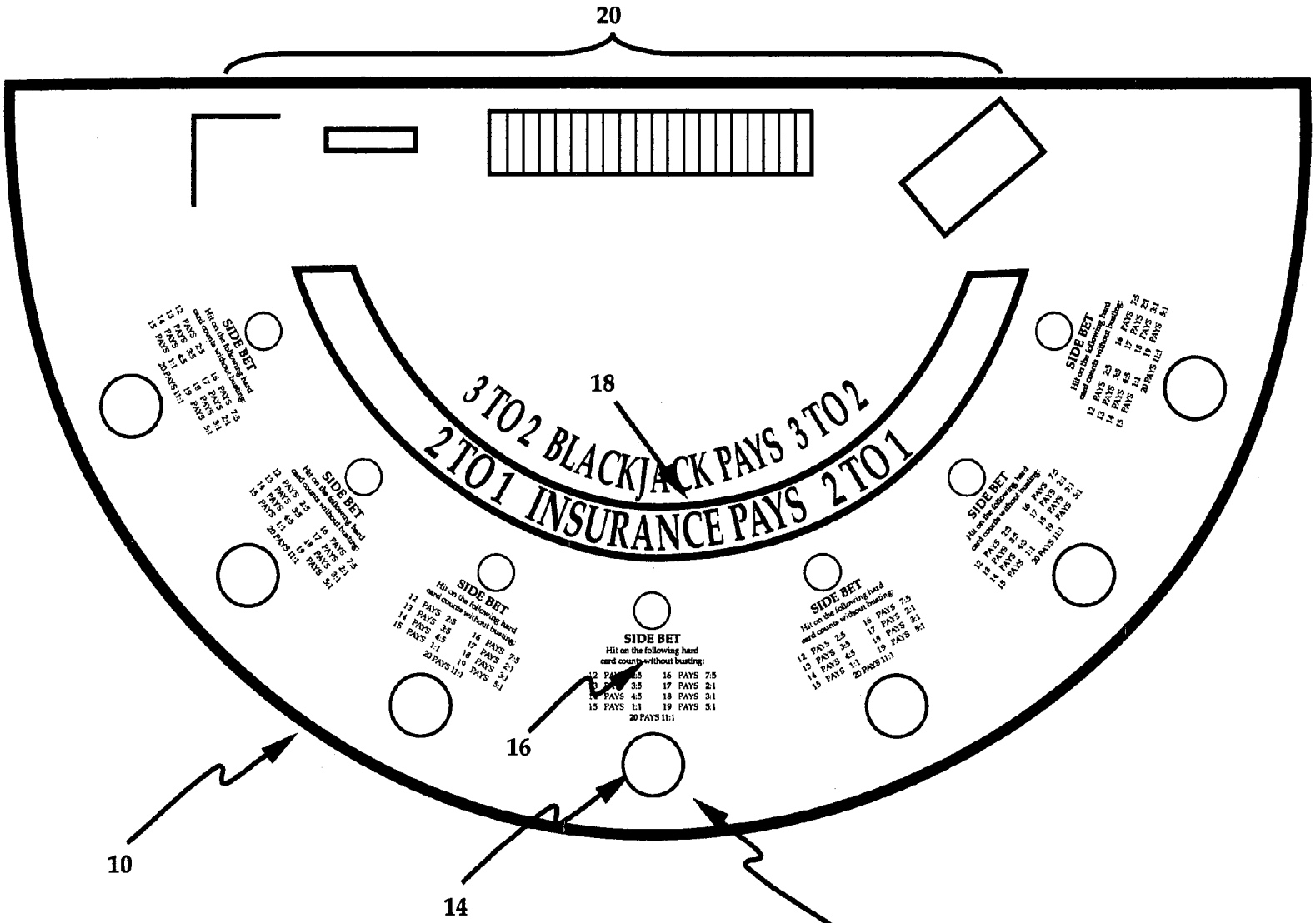
FIG. 5 is an illustration of a playing surface for a casino-style gaming table that can be utilized for the various embodiments of the invention.
Figure 6:
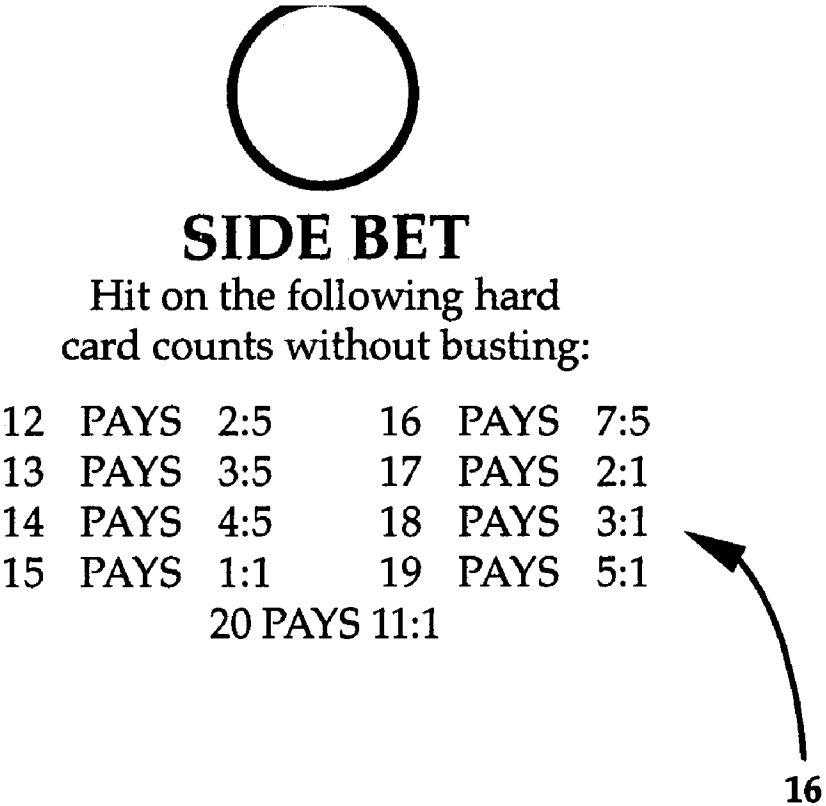
FIG. 6 is an enlarged illustration of the player betting area specific to the invention represented in FIG. 5.

FIG. 5 represents a third embodiment of the invention where the additional player betting area 16 provides a single betting space for the hard card counts for which the player is allowed to place a side bet specific to the invention, and a separate payout table is printed on the playing surface that delineates the payouts for all the side bets specific to the invention offered. FIG. 6 is an enlarged illustration of the additional player betting area 16 for the embodiments of the invention represented by FIG. 5. This embodiment allows for a side bet that the player will not bust on the next card drawn when the player has any of the hard card counts 12, 13, 14, 15, 16, 17, 18, 19 or 20. However, it is to be understood that the invention allows for any combination of one or more of the nine hard card counts 12, 13, 14, 15, 16, 17, 18, 19 or 20 to be offered as side bet opportunities.

Figure 7:
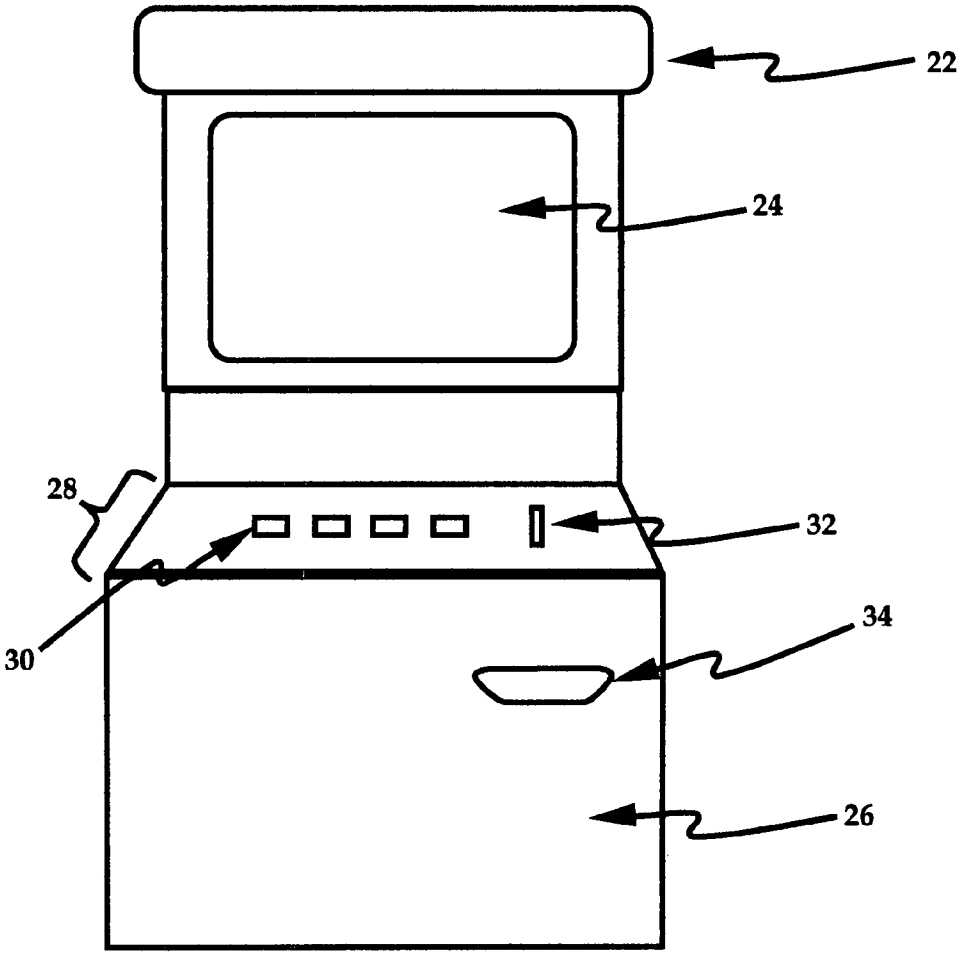
FIG. 7 is an example of a video gaming machine apparatus of the type on which the various embodiments of the present invention may be played.

FIG. 7 is an illustration of a casino-style video gaming machine apparatus on which the various embodiments of the invention can be played. The apparatus typically includes a physical housing 22, an electronic display monitor 24, a computer processor and computer program designed to conduct the game through random number generation technology 26, a player interface console 28 that includes buttons of some sort by which the player can input decisions for the game 30, an input device for depositing funds via coins, bank cards or casino debit cards 32 and an output device for returning sums to the player 34.

Figure 8:
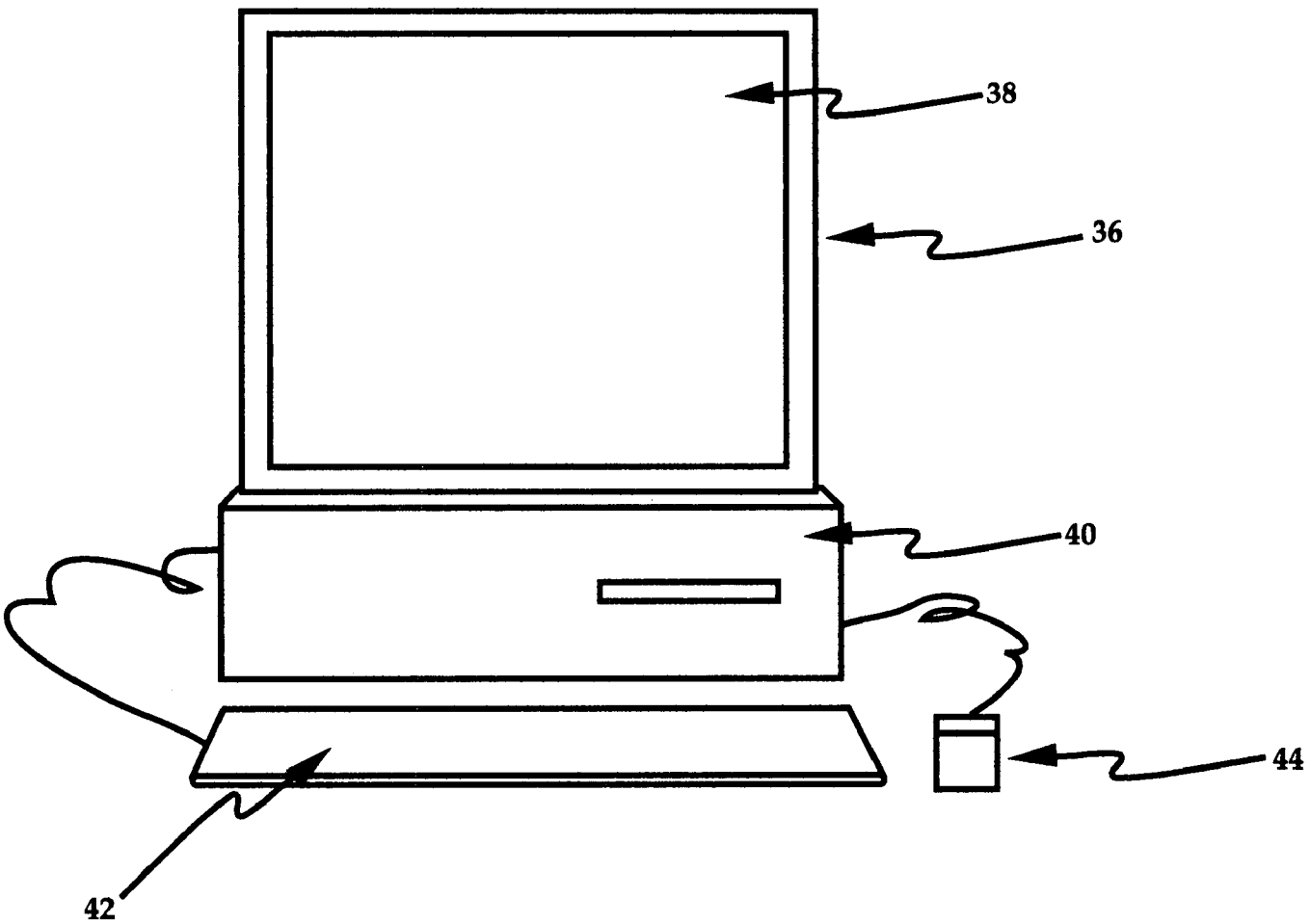
FIG. 8 is an example of a personal computer apparatus of the type on which the various embodiments of the present invention may be played.

FIG. 8 is an illustration of a personal computer apparatus on which the various embodiments of the invention can be played off-line or online over the internet at virtual casinos. The personal computer apparatus typically includes a physical housing 36, an electronic display monitor 38, a computer processor and computer program designed to conduct the game through random number generation technology or via the internet at an online virtual casino 40, and a computer keyboard 42 and/or mouse device 44 to assist in play of the game.

The following descriptions of the flow charts illustrated in FIGS. 9-13 illustrate the versatility of the timing and manner in which side bets according to the principles of the present invention may be made. While the flow charts demonstrate single player examples for purposes of clarity, it is to be understood that multiple players can easily be accommodated by appropriately utilizing the appropriate section of the flow chart for each player. It is also to be understood that the various embodiments of the invention allow for slight variations in rules or procedure for the underlying blackjack game as offered by various casino operators.

Figure 9:
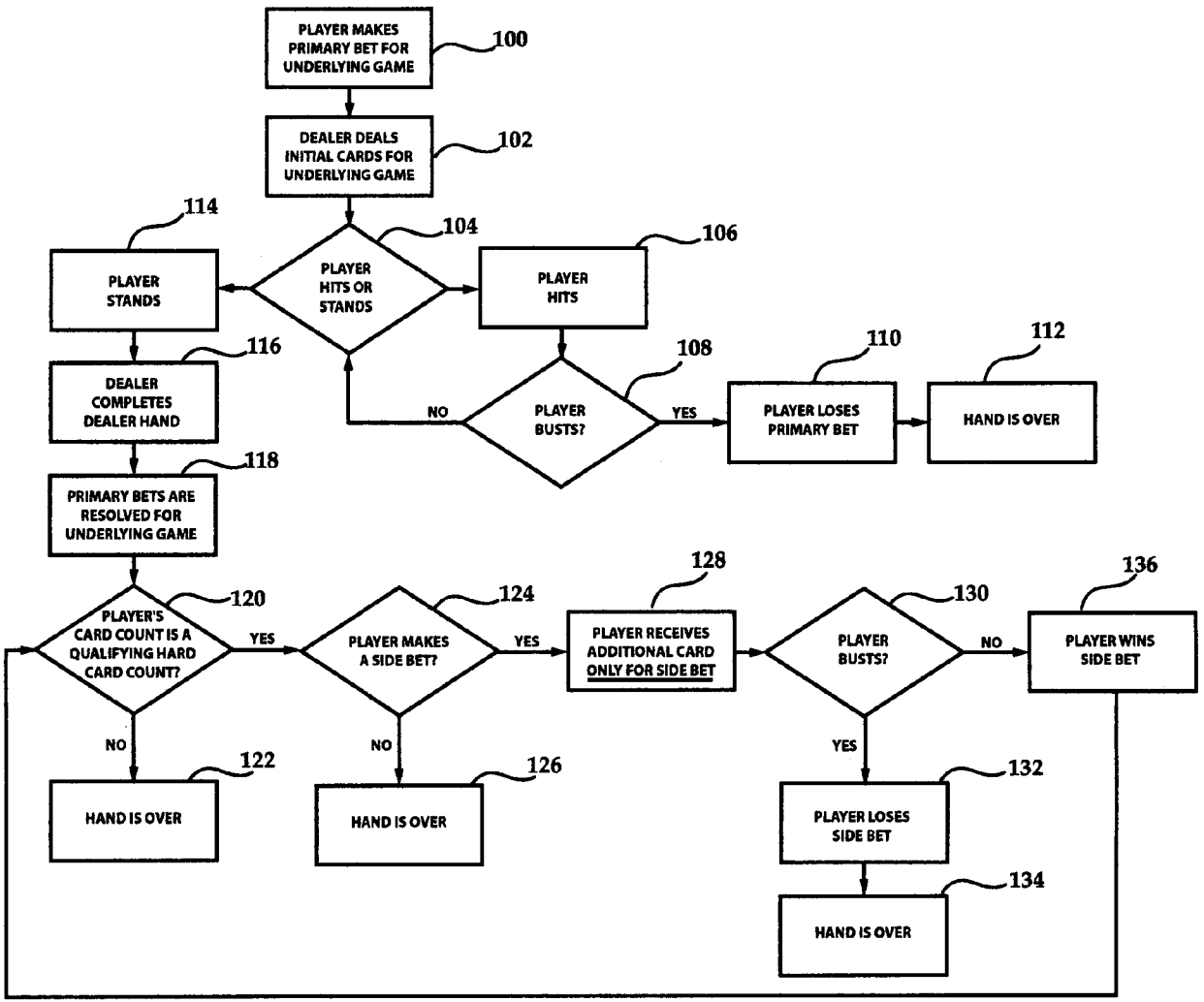
FIG. 9 is a flow chart of a game method according to an embodiment of the present invention.

Turning now to FIG. 9, a flow chart of a game method according to an embodiment of the present invention is illustrated. In this embodiment, the player places a side bet specific to the invention after the dealer completes his own hand and the primary bets for the underlying blackjack game against the dealer's hand have been resolved for all players. In this embodiment, any additional cards drawn for a side bet are not applied to the card count for the underlying game against the dealer's hand.

In this embodiment, the game begins at step 100 where the player makes a primary bet for the underlying blackjack game against the dealer's hand. At step 102, the dealer deals the initial cards for the underlying blackjack game in accordance with the traditional rules of blackjack, where each player and the dealer receive two cards in rotation with the player receiving both cards face-up and the dealer receiving one card face-up and one card face-down (it will be appreciated that in some jurisdictions and/or casinos the cards are dealt face-up or face-down in a different manner). At step 104, the player has the choice to either "stand," which means the player decides to take no additional cards, or "hit," which means the player decides to take an additional card. If the player decides to hit at step 106, the dealer will deal the player an additional card. At step 108 it is determined whether the additional card causes the player to exceed a card count of 21, otherwise known as a "bust." If the player busts, then the player loses his primary bet for the underlying game at step 110 and the hand will be over for the player at step 112.

If the player decides to hit at step 106 and the player does not bust at step 108, then the game will loop back to step 104 where the player once again has the choice to stand or hit. Referring again to step 104 where the player has the choice to stand or hit, if the player decides to stand at step 114, the dealer will complete his own hand at step 116 in accordance with the traditional rules of blackjack well-known to those skilled in the art and will then resolve the player's primary bet for the underlying blackjack game against the dealer's hand at step 118. At step 120, after all players' bets for the underlying blackjack game against the dealer's hand are resolved, each player's final card count will be examined to see if it is a qualifying hard card count for a side bet specific to the invention. If the player's final card count is not a qualifying hard card count, the player's hand is over at step 122.

If at step 120, the player's final card count is a qualifying hard card count, then the player will have the choice of making a side bet at step 124. If the player decides not to make a side bet, then the hand is over for the player at step 126. If the player does make a side bet, then the player will receive an additional card at step 128 that is added to his final card count for the side bet but is not applied to the card count for the underlying game against the dealer's hand, which was previously resolved. At step 130, it is determined whether the additional card causes the player's card count to exceed 21. If it does, then the player will lose the side bet at step 132 and the hand is over for the player at step 134.

If the player does not exceed 21 with the additional card drawn, then the player wins the side bet at step 136 and the game loops back to step 120 where it is determined if the player's new card count is a qualifying hard card count.

Figure 10:
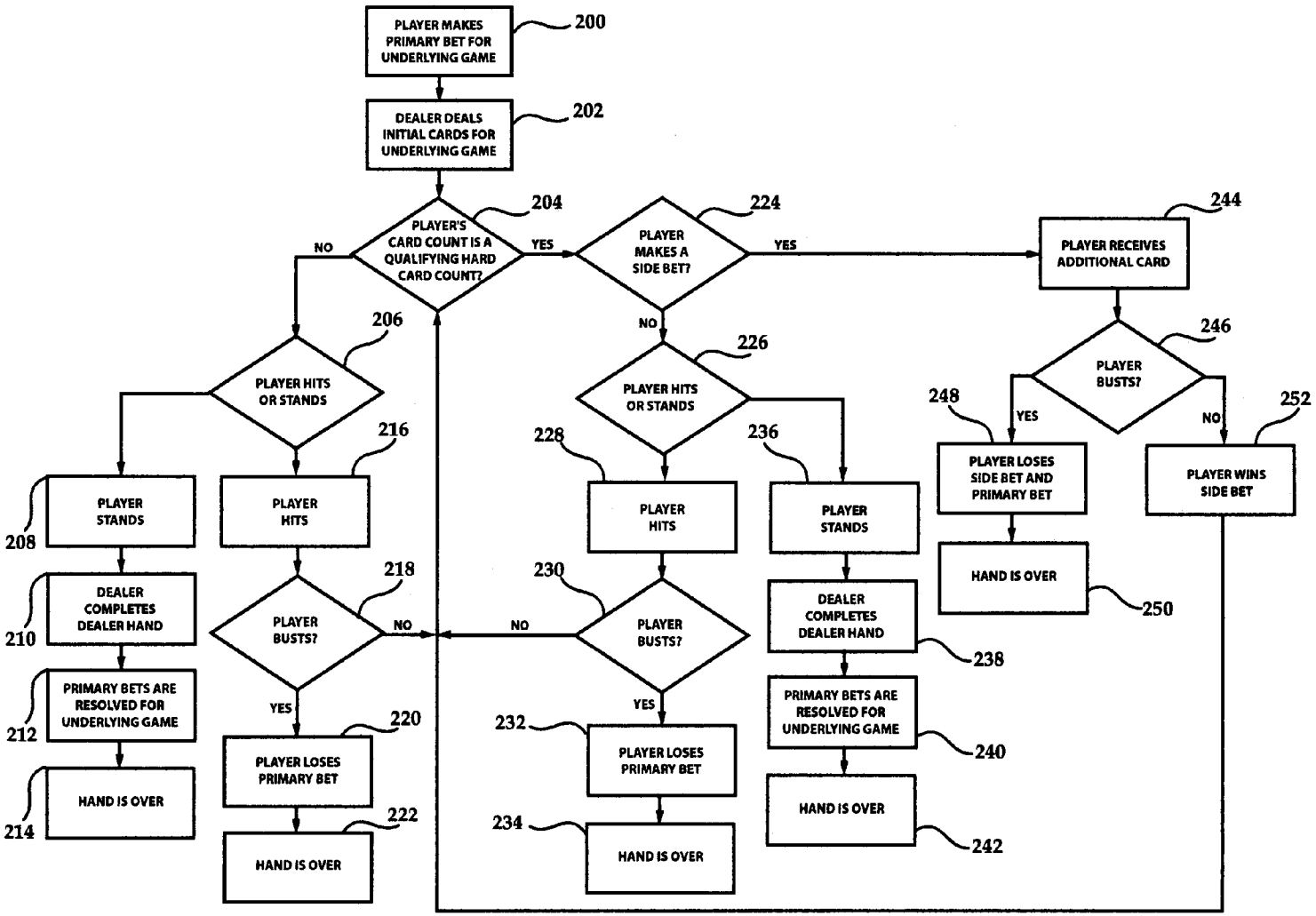
FIG. 10 is a flow chart of a game method according to an embodiment of the present invention.

FIG. 10 is a flow chart of another embodiment. In this embodiment, the player places a side bet while each individual player's underlying blackjack hand is being played out—as opposed to waiting until all players' hands and the dealer's hand are completed—and any additional cards drawn for a side bet also apply towards the card count for the underlying game against the dealer's hand.

The game begins at step 200 where the player makes a primary bet for the underlying blackjack game against the dealer's hand. At step 202, the dealer deals the initial cards for the underlying blackjack game in accordance with the traditional rules of blackjack, where each player and the dealer receive two cards in rotation with the player receiving both cards face-up and the dealer receiving one card face-up and one card face-down. At step 204, it is determined whether the player's card count is a qualifying hard card count. If it is not, then the player has the choice to either stand or hit at step 206. If the player stands at step 208, then the dealer will complete his own hand at step 210 and will resolve the player's primary bet for the underlying game against the dealer's hand at step 212 and the hand will then be over at step 214.

Returning to step 206, if the player hits at step 216, it will be determined if the additional card causes the player to bust at step 218. If the player busts, the player loses his primary bet for the underlying game against the dealer's hand at step 220 and the hand will be over at step 222. Returning to step 218, if the additional card does not cause the player to bust, then the game will loop back to step 204 where it is determined if the player's new card count is a qualifying hard card count. Referring again to step 204, if it is determined that the player's card count is a qualifying hard card count, then the player has the choice of making a side bet at step 224. If he does not make a side bet, then the player can decide to hit or stand at step 226. If the player hits at step 228, it will then be determined if the additional card causes the player to bust at step 230. If he does not bust, then the game loops back to step 204. If the additional card does cause the player to bust, then the player loses his primary bet for the underlying game against the dealer's hand at step 232 and the hand is over for the player at step 234.

Returning to step 226, if the player decides to stand at step 236, then the dealer will complete his own hand at step 238 and will resolve the player's primary bet against the dealer's hand at step 240 and the player's hand will be over at step 242. Returning to step 224, if the player decides to make a side bet, then the player will receive an additional card at step 244 that applies to both his card count for the underlying game against the dealer's hand as well as the side bet. At step 246 it is determined whether the additional card causes the player to bust. If it does, then the player loses the side bet as well as his primary bet for the underlying game against the dealer's hand at step 248 and the hand is over for the player at step 250.

If at step 246, the player does not bust, the player wins the side bet at step 252 and the game loops back to step 204 where it is determined if the player's new card count is a qualifying hard card count.

Figure 11:
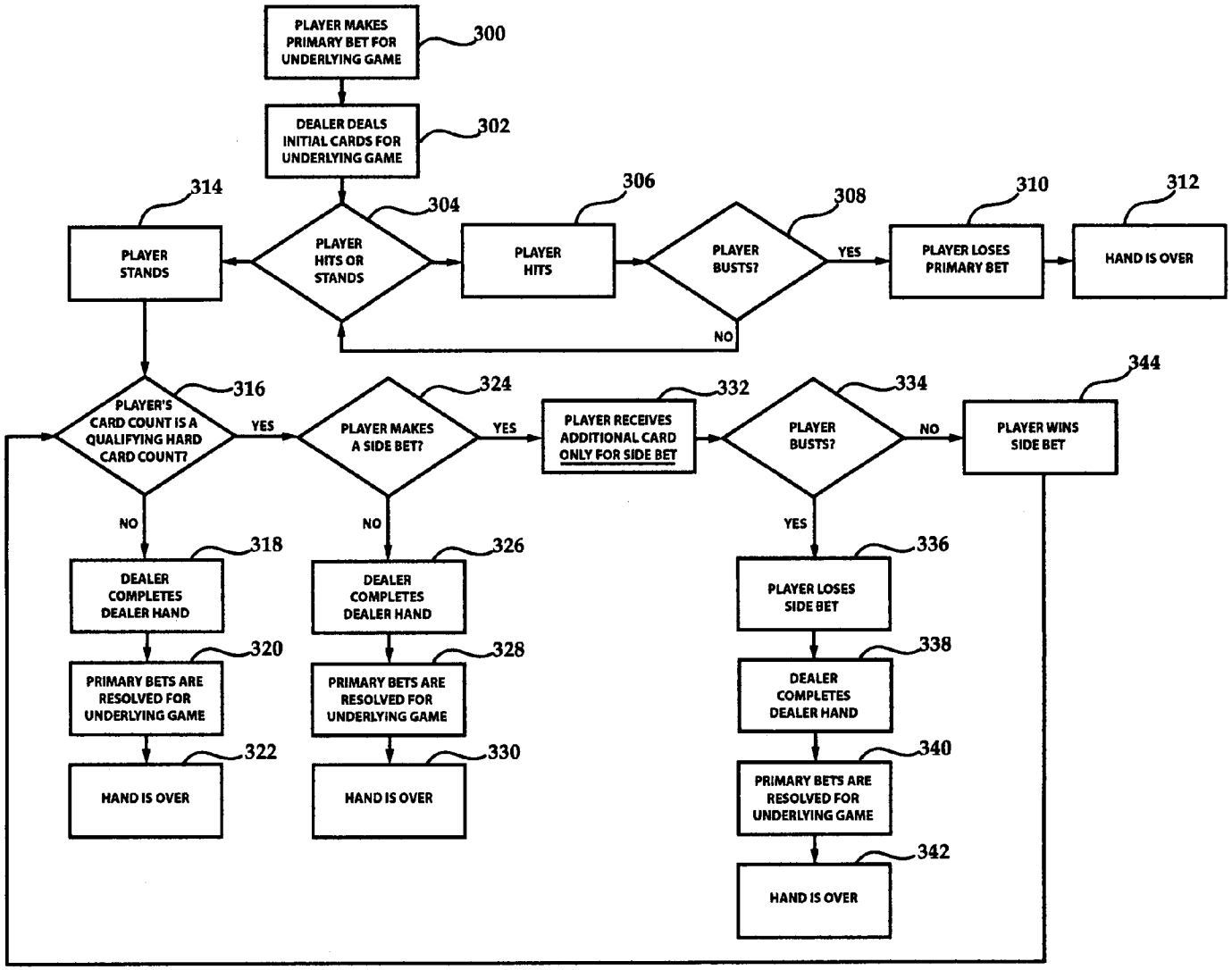
FIG. 11 is a flow chart of a game method according to an embodiment of the present invention.

FIG. 11 is a flow chart of a third embodiment where the player places a side bet after each individual player chooses to stop receiving cards for the underlying game against the dealer's hand but before the dealer completes his own hand. In this embodiment, any additional cards drawn for a side bet are not applied towards the card count for the underlying game against the dealer's hand.

The game begins at step 300 where the player makes a primary bet for the underlying blackjack game against the dealer's hand. At step 302, the dealer deals the initial cards for the underlying blackjack game in accordance with the traditional rules of blackjack, where each player and the dealer receive two cards in rotation with the player receiving both cards face-up and the dealer receiving one card face-up and one card face-down. At step 304, the player has the choice to either stand or hit. If the player decides to hit at step 306, the dealer will deal the player an additional card. At step 308 it is determined whether the additional card causes the player to bust. If the player busts, then the player loses his primary bet for the underlying game at step 310 and the hand will be over for the player at step 312.

If the player does not bust at step 308, then the game will loop back to step 304 where the player once again has the choice to stand or hit. Referring again to step 304 where the player has a choice to stand or hit, if the player decides to stand at step 314, then it is determined if the player's final card count for the underlying game against the dealer's hand is a qualifying hard card count at step 316. If the player's card count is not a qualifying hard card count, then the dealer completes his own hand at step 318 and the player's primary bet for the underlying game against the dealer's hand is resolved at step 320 and the hand is over at step 322.

Returning to step 316, if the player's card count is a qualifying hard card count, then the player has the choice of making a side bet at step 324. If the player does not make a side bet, then the dealer completes his own hand at step 326 and the player's primary bet for the underlying game against the dealer's hand is resolved at step 328 and the hand is over at step 330.

Returning to step 324, if the player does make a side bet, then he receives an additional card at step 332 that is only added to the card count as it applies to the side bet. To avoid confusing the two card counts, the additional card drawn that only affects the card count for the player's side bets could be placed away from the cards for his underlying hand against the dealer's hand. At step 334, it is determined whether the additional card causes the player's card count to exceed 21. If the additional card does cause the player's card count to exceed 21, then the player loses the side bet at step 336. The dealer then completes his own hand for the underlying game at step 338 and the player's primary bet for the underlying game against the dealer's hand is resolved at step 340 and the hand is then over at step 342.

Returning to step 334, if the additional card drawn for the side bet does not cause the player's hand to exceed 21, then the player wins the side bet at step 344 and the game loops back to step 316 where it is determined if the player's new card count is a qualifying hard card count.

Figure 12:
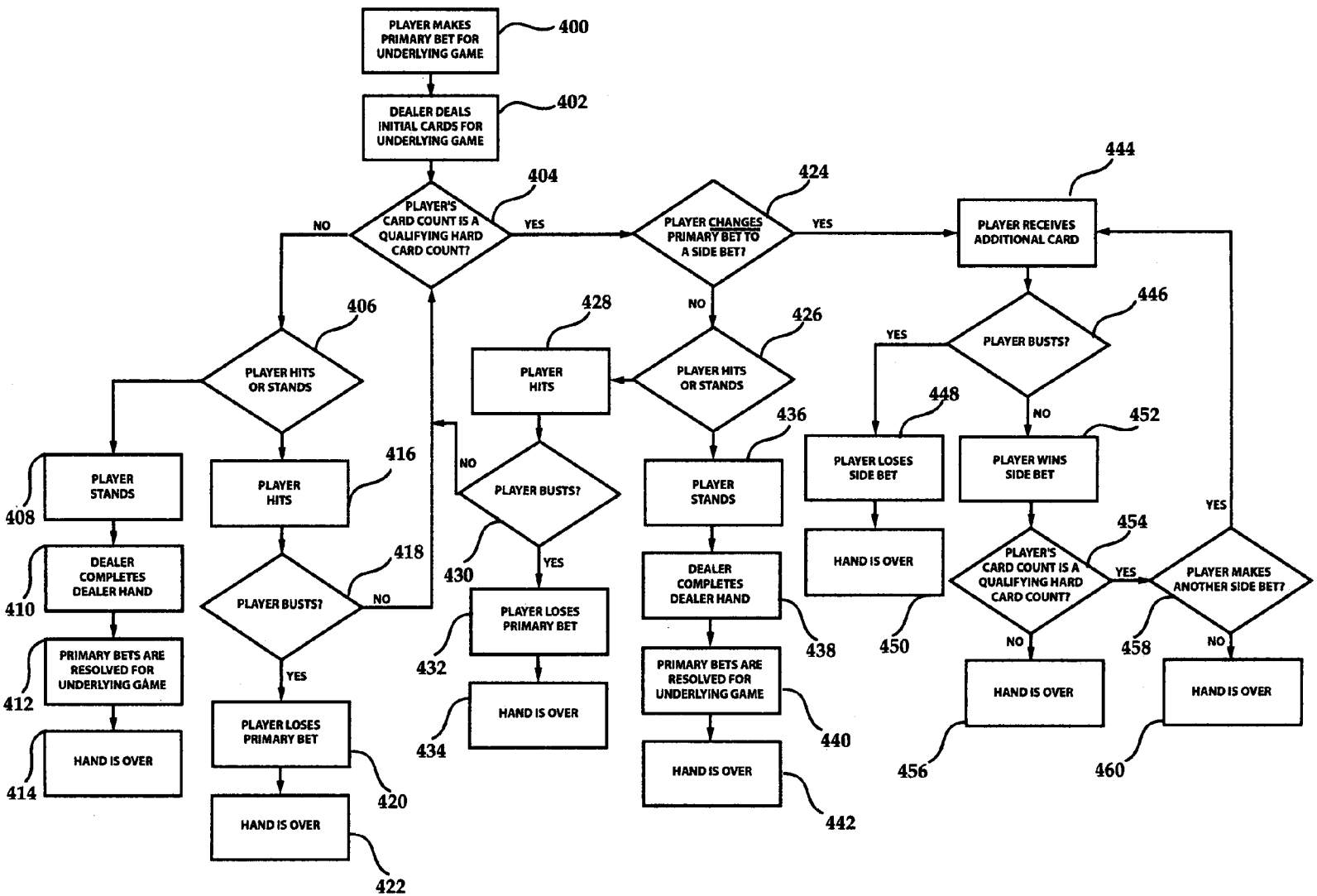
FIG. 12 is a flow chart of a game method according to an embodiment of the present invention.

FIG. 12 is a flow chart of a fourth embodiment where instead of making separate side bets in addition to a primary wager for the underlying game against the dealer's hand, the player can opt to change his primary bet to a side bet specific to the invention when he has a qualifying hard card count. In this embodiment of the invention, once the player changes his primary bet to a side bet, he is no longer playing against the dealer's hand at all, but is strictly wagering that he will not bust with each additional card drawn.

The game begins at step 400 where the player makes a primary bet for the underlying blackjack game against the dealer's hand. At step 402, the dealer deals the initial cards for the underlying blackjack game in accordance with the traditional rules of blackjack, where each player and the dealer receive two cards in rotation with the player receiving both cards face-up and the dealer receiving one card face-up and one card face-down. At step 404, it is determined whether the player's card count is a qualifying hard card count. If it is not, then the player has the choice to either stand or hit at step 406. If the player stands at step 408, then the dealer will complete his own hand at step 410 and will resolve the player's primary bet for the underlying game against his hand at step 412 and the hand will then be over at step 414.

Returning to step 406, if the player hits at step 416, it will be determined if the additional card causes the player to bust at step 418. If the player busts, the player loses his primary bet for the underlying game against the dealer's hand at step 420 and the hand will be over at step 422.

Returning to step 418, if the additional card does not cause the player to bust, then the game will loop back to step 404 where it is determined if the player's new card count is a qualifying hard card count. Referring again to step 404, if the player's card count is a qualifying hard card count, then the player has the option to change his primary bet for the underlying game against the dealer's hand to a side bet specific to the invention at step 424. If the player chooses not to change his primary bet to a side bet, then the player has the choice to hit or stand at step 426. If the player hits at step 428, it is determined if the additional card causes the player to bust at step 430. If the player busts, then the player loses his primary bet for the underlying game against the dealer's hand at step 432 and the hand is over for the player at step 434.

Returning to step 430, if the player does not bust, then the game loops back to step 404. Returning to step 426 where the player has the option to hit or stand, if the player stands at step 436, then the dealer completes his own hand at step 438 and the player's primary bet for the underlying game against the dealer's hand is resolved at step 440 and the hand is then over for the player at step 442.

Returning to step 424 where the player has the option to change his primary bet to a side bet, if the player does change his primary bet to a side bet, then the player receives an additional card at step 444. At step 446, it is determined if the additional card causes the player to bust. If the player busts, then the player loses the side bet that was changed from a primary bet at step 448 and the hand is over for the player at step 450.

Returning to step 446 where it is determined if the additional card drawn causes the player to bust, if the player does not bust, then the player wins the side bet that was changed from a primary bet at step 452. At step 454, it is determined if the new card count is a qualifying hard card count. If it is not, then the hand is over for the player at step 456.

Returning to step 454, if the new card count is a qualifying hard card count, then the player has the choice of making another side bet at step 458. If the player makes another side bet, then the game loops back to step 444. If the player does not make another side bet, then the hand is over for the player at step 460.

Figure 13:
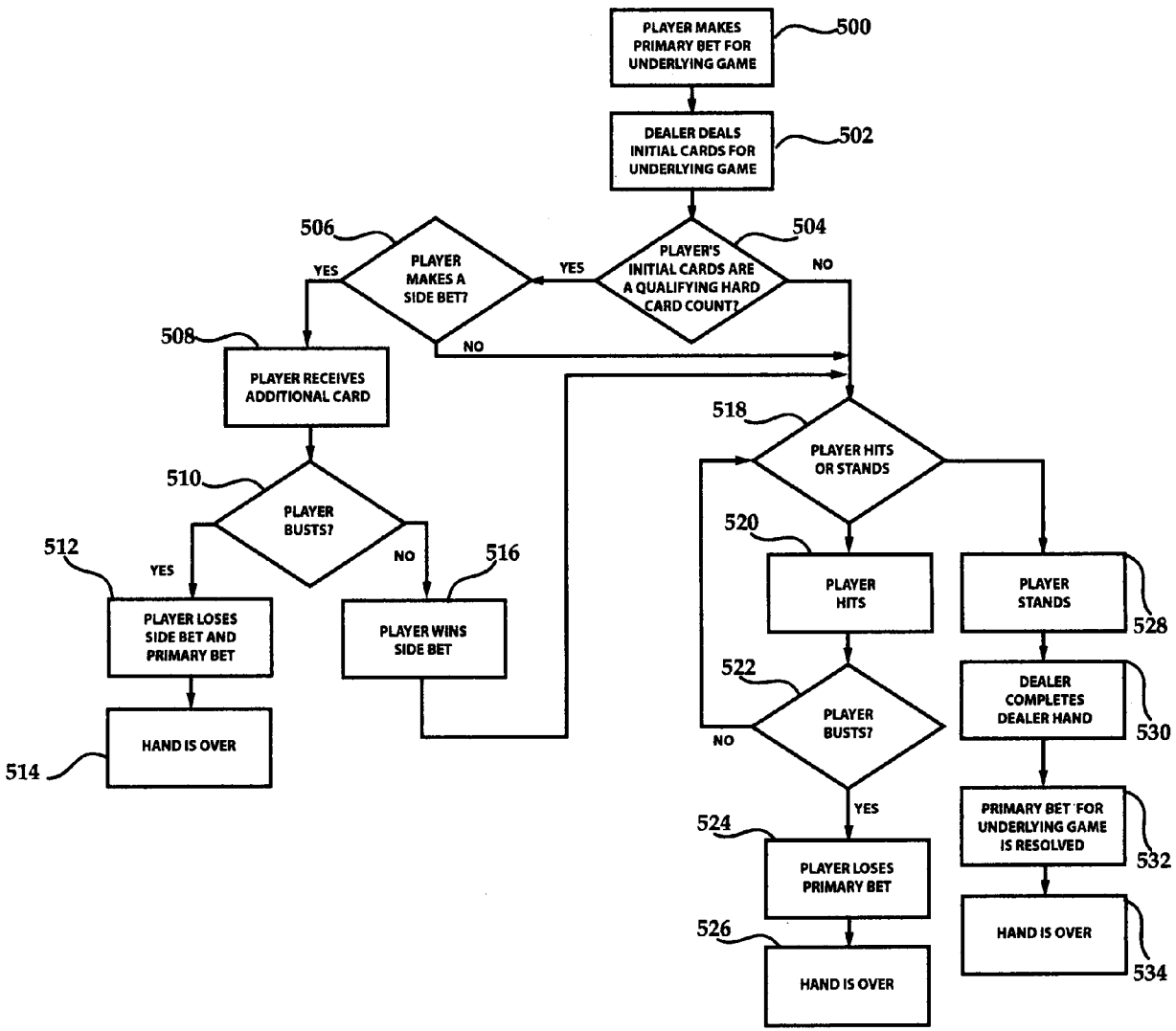
FIG. 13 is a flow chart of a game method according to an embodiment of the present invention.

FIG. 13 is a flow chart of a fifth embodiment where the player places a side bet which is limited to the player's two initial cards for the underlying game against the dealer's hand.

In this embodiment, the game begins at step 500 where the player makes a primary bet for the underlying blackjack game against the dealer's hand. At step 502, the dealer deals the initial cards for the underlying blackjack game in accordance with the traditional rules of blackjack, where each player and the dealer receive two cards in rotation with the player receiving both cards face-up and the dealer receiving one card face-up and one card face-down. At step 504, it is determined if the player's initial two cards constitute a qualifying hard card count. If the player's initial two cards constitute a qualifying hard card count, then the player has the option to make a side bet at step 506. If the player makes a side bet, then the player receives an additional card at step 508 that applies toward the side bet as well as the card count for the underlying game against the dealer's hand. At step 510, it is determined whether the additional card causes the player to bust. If the additional card causes the player to bust, then the player loses the side bet as well as the primary bet for the underlying game against the dealer's hand at step 512 and the hand is then over at step 514.

If the player does not bust at step 510, then the player wins the side bet at step 516 and the game proceeds to step 518 where the player has the choice to hit or stand in accordance with the traditional rules of blackjack. At this point, the player has no additional side bet opportunities. Returning to step 506, if the player chooses not to make a side bet, then the game also proceeds to step 518 where the player has the choice to hit or stand in accordance with the traditional rules of blackjack and the player has no side bet opportunities. Returning to step 504, if the player's initial cards are not a qualifying hard card count then the game also proceeds to step 518 where the player has the choice to hit or stand in accordance with the traditional rules of blackjack and the player has no side bet opportunities. If the player decides to hit at step 520, it is determined if the additional card causes the player to bust at step 522. If the player does not bust, then the game loops back to step 518 where once again the player has the choice to hit or stand in accordance with the traditional rules of blackjack. If at step 522, the player does bust, then the player loses the primary bet for the underlying game against the dealer's hand at step 524 and the hand is over at step 526.

Returning to step 518, if the player decides to stand at step 528, then the dealer completes his own hand at step 530 and the primary bet for the underlying game is resolved at step 532 and the hand is then over at step 534.

Additional Options

For all embodiments of the invention, if the dealer is dealt a natural blackjack, the underlying game against the dealer's hand is immediately resolved. In this scenario, the player either loses the underlying hand against the dealer or ties with a natural blackjack. If the player does not have a natural blackjack, the casino operator has the option of allowing a side bet specific to the invention if the player's two initial cards constitute a qualifying hard card count.

For all embodiments of the invention, the casino operator can decide which of the nine hard card counts 12, 13, 14, 15, 16, 17, 18, 19 and 20 constitute qualifying hard card counts for a side bet specific to the invention.

For all embodiments of the invention, the casino operator may decide whether the player can place side bets as the hand progresses or whether the player must place one or more side bets before the hand begins if he wishes to take advantage of any side bet opportunity. If the player must place his side bets before the hand begins, any side bet placed for which a predetermined side bet event does not occur would be returned to the player at the end of the hand.

For all embodiments of the invention, the casino operator can establish how many successive side bets the player can make within each hand played.

For all embodiments of the invention, the casino operator has the option of offering the side bets specific to the invention if a player chooses to split his cards and the additional card or cards added to a split card equals a hard card count.

For all embodiments of the invention, in blackjack games that offer the option of doubling down on any initial two cards, the player cannot take additional cards after the third card if the player makes both a double-down side bet and a side bet specific to the invention, because the double-down bet would preclude the right to take additional cards after the third card.

For all embodiments of the invention, the casino operator has the option of allowing the player to increase (or "parlay") all or part of the winnings of each successful, successive side bet in accordance with prescribed bet limits. Additionally, for all embodiments, the casino operator can decide if the player can withdraw his winnings after each successful, successive side bet and continue to risk the principal side bet or a lesser amount for any successive side bet specific to the invention as long as the bet meets the minimum bet amount as prescribed by the casino operator.

For all embodiments of the invention, the casino operator may offer the player the option of placing successive side bets as well as non-successive side bets, where if the player draws multiple, qualifying hard card counts, he can skip placing a side bet on any given qualifying hard card count but still place a side bet on a later qualifying hard card count within the same hand played. In other words, each qualifying hard card count side bet opportunity can be treated independently of the last qualifying hard card count side bet opportunity within the same hand played as long as each side bet placed subscribes to the side bet minimum and maximum established by the casino operator.

Underlying Mathematical Principles

The various side bet scenarios specific to the invention are based on the mathematical probability of a player not busting with the next card drawn whenever he has a hard card count of 12, 13, 14, 15, 16, 17, 18, 19 or 20 using one or more standard 52-card decks. Given that for any blackjack hand with a hard card count of 12, 13, 14, 15, 16, 17, 18, 19 or 20, there is a fixed probability of the player busting or not busting with an additional card drawn, specific betting scenarios with specified payouts that include a house edge can be offered using the following mathematical table and formulas. It is to be understood that the sample payouts listed below are simply examples and that any payout can be offered as deemed appropriate by the gaming operator.

PAYOUT TABLE

| Hard Card Count | Probability of Busting on Next Card | Probability of Not Busting on Next Card | True Odds Payout for Not Busting on Next Card | Sample Payout for Not Busting on Next Card | House Edge |
|---|---|---|---|---|---|
| 12 | .3076923 | .6923077 | 0.444:1 | 2:5 | 3.1% |
| 13 | .3846153 | .6153847 | 0.625:1 | 3:5 | 1.5% |
| 14 | .4615384 | .5384616 | 0.857:1 | 4:5 | 3.1% |
| 15 | .5384615 | .4615385 | 1.167:1 | 1:1 | 7.7% |
| 16 | .6153846 | .3846154 | 1.6:1 | 7:5 | 7.7% |
| 17 | .6923076 | .3076924 | 2.25:1 | 2:1 | 7.7% |
| 18 | .7692307 | .2307693 | 3.3:1 | 3:1 | 7.7% |
| 19 | .8461538 | .1538462 | 5.5:1 | 5:1 | 7.7% |
| 20 | .9230769 | .0769231 | 12:1 | 11:1 | 7.7% |

To calculate the true odds payout (T) for any side bet scenario specific the invention, the probability for a winning event occurring (W), that is, not exceeding 21 on the next card drawn for any given qualifying hard card count, is divided into the sum of the probabilities for a losing event occurring (L), that is, exceeding 21 on the next card drawn for any given qualifying hard card count.

$$T=L/W$$

As an example, to calculate the true odds payout for not busting on the next card drawn when the player has a hard card count of 15, one divides the probability of the player not busting (0.4615385) into the probability of the player busting (0.5384615) to reach the result of 1.167:1.

$$T=0.5384615/0.4615385=1.167:1$$

By offering a proposed payout (P) that is less than the true odds payout (T), the house retains a given edge (E) for any given side bet scenario. To calculate the house edge for any side bet scenario and proposed payout, one can apply the following mathematical formula:

$$E=L-(W\times P)$$

Using the same example of a player taking an additional card with a hard card count of 15 and a proposed payout of 1:1 if he does not bust, the house edge for the betting scenario would be calculated as follows:

$$E=L-(W\times P)$$

$$E=0.5384615-(0.4615385\times 1)$$

$$E=0.077$$

$$E=7.7\%$$

It is to be understood that additional mathematical formulas can be applied to derive the house edge for various embodiments of the invention. It should also be understood that for certain embodiments of the invention, alterations of traditional payouts for certain bets relative to the underlying blackjack game can be made in order to make the house edge for certain embodiments of the invention more appealing to gaming operators and/or gaming patrons.

Finally, it is to be understood that the embodiments shown and described herein are merely illustrative of the principles of this invention and that various modifications may be implemented by those skilled in the art without departing from the scope and spirit of the invention.

What is claimed is:

1. A method of playing the card game Blackjack, the Blackjack game including a dealer and at least one player, comprising:

a) placing a primary wager by the player on a Blackjack playing surface for the underlying Blackjack game;

b) dealing two initial cards to both the player and the dealer by placing the cards onto the Blackjack playing surface;

c) providing the player with an option to place a side wager on the Blackjack playing surface if the two initial cards dealt to the player equal a qualifying hard card count, wherein the qualifying hard card count is one of a predetermined set of hard counts, the predetermined set defined as a hard 12, 13, 14, 15, 16, 17, 18, 19 or 20;

d) dealing a third card to the player; and e) determining the outcome of an optionally placed side wager, wherein:

i) the placed side wager is won by the player if the third card dealt to the player, when added to the hard card count, does not cause the hard card count to exceed twenty-one; and ii) the placed side wager is lost by the player if the third card dealt to the player, when added to the hard card count, causes the hard card count to exceed twenty-one.

2. The method of playing the card game according to claim 1, wherein the qualifying hard card count is determined by counting any aces dealt to the player as equal to one.

3. The method of playing the card game according to claim 1, further comprising the step of providing the player with an option to place a side wager after the third card, and each subsequent card, is dealt to the player as long as the card count total of all of the cards dealt to the player is equal to one of the predetermined set of hard counts.

4. The method of playing the card game according to claim 1, wherein the payout on a successful side wager is directly related to the probability of not exceeding a card count of twenty-one when an additional card is added to the qualifying hard card count.

5. The method of playing a card game according to claim 1, wherein the placed side wager is positioned in a predetermined, marked area on the Blackjack playing surface.

6. The method of playing a card game according to claim 1, further comprising completing the underlying Blackjack game and determining if the primary wager is won or lost by comparing the total of the cards dealt to the player against the total of the cards dealt to the dealer.

7. The method of playing the card game according to claim 1, further comprising the use of one or more standard 52-card decks of playing cards.

8. The method of playing the card game according to claim 1, further comprising using a programmed computer or random number generator to generate the value of the cards.

9. The method of playing the card game according to claim 1, wherein the steps are performed in order.

* * * * *

UNITED STATES PATENT AND TRADEMARK OFFICE

CERTIFICATE OF CORRECTION

PATENT NO. : 7,648,140 B2
APPLICATION NO. : 11/540399
DATED : January 19, 2010
INVENTOR(S) : Bruce David Silverman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 646 days.

Signed and Sealed this

Twenty-eighth Day of December, 2010

David J. Kappos

David J. Kappos
*Director of the United States Patent and Trademark Office*